United States Patent [19]

Kotcharian

[11] 4,003,174

[45] Jan. 18, 1977

[54] METHOD OF MOUNTING A COMPOSITE WALL STRUCTURE AND CORRESPONDING WALL STRUCTURE THUS OBTAINED

[75] Inventor: Michel Kotcharian, Paris, France

[73] Assignee: Technigaz, Paris, France

[22] Filed: Sept. 26, 1975

[21] Appl. No.: 617,237

[30] Foreign Application Priority Data

Sept. 27, 1974 France ..... 74.32739

[52] U.S. Cl. ..... 52/415; 52/391; 52/746

[51] Int. Cl.[2] ..... E04B 2/00; E04F 13/08; E04G 21/00

[58] Field of Search ..... 52/390, 391, 415, 422, 52/746

[56] References Cited

UNITED STATES PATENTS

| | | | |
|---|---|---|---|
| 2,151,597 | 3/1939 | Hamilton | 52/390 X |
| 3,362,120 | 1/1968 | Warren | 52/746 |
| 3,676,970 | 7/1972 | Edwards | 52/391 |

OTHER PUBLICATIONS

Progressive Architecture, Mar. 1963, pp. 62 & 63.

*Primary Examiner*—J. Karl Bell
*Attorney, Agent, or Firm*—Kenyon & Kenyon Reilly Carr & Chapin

[57] ABSTRACT

A method of building a composite wall construction comprising the steps of applying patches of a deformable cement-like stuffing or packing compound onto the outer faces of lining elements and then applying said lining elements to a rigid self-supporting wall while gradually squashing said patches of compound by means of pressure exerted thereon through abutment means by screwing nuts thereon.

18 Claims, 12 Drawing Figures

METHOD OF MOUNTING A COMPOSITE WALL STRUCTURE AND CORRESPONDING WALL STRUCTURE THUS OBTAINED

The present invention relates to a method of mounting or making a composite wall structure; it is moreover directed to said composite wall structure.

The assembly of at least two elementary walls or layers to form a composite wall construction of the laminated type should in some cases be carried out by strictly controlling the final position of one wall or layer with respect to the other wall or layer or, since this other wall or layer is in a stationary position or a position considered to be stationary, with respect to a geometrical reference element of predetermined fixed position with respect to said other wall or layer, for example a plane extending substantially in parallel relation to said other wall or layer.

This problem is set in particular when this other wall or layer is a rigid self-supporting wall to which has to be added and secured in a predetermined position at least one bedding or layer consisting of lining or facing elements juxtaposed at the surface thereof. This is for instance the case when said composite wall is a wall of a fluid-tight heat insulated tank comprising an outer wall forming said rigid self-supporting wall, at least one layer of panels made from heat insulating material and forming said lining or facing elements and possibly an inner sealing or impervious barrier. Generally it is also highly desirable and indispensable for tanks or vessels of large sizes likely to exhibit fairly large irregularities of raised pattern at the inside face of their outer wall like those provided by the holds of ships adapted for instance to the conveyance of liquefied hydrocarbons, to ascertain the accurate final positions of the inner faces of the lining of facing elements or insulating panels; the inner faces of the various insulating panels should be arranged according to a flat or curved surface (or form dihedral angles or trihedrons in some peculiar areas of said tanks) of predetermined fixed position, referred to hereinafter as a "reference plane" and comprise no substantial surface irregularity notwithstanding the surface irregularities of the inner face of said outer wall. The fastening of the inner faces of said insulating panels onto said reference plane also enables, when the composite tank-wall comprises a thin and accordingly relatively fragile sealing barrier to provide a perfect support for the latter while avoiding any risk of breaking said barrier. It should be borne in mind that any failure of such a barrier could seriously damage or impair the composite tank-wall in particular in the case of a ship's hold carrying a liquefied hydrocarbon gas at a very low temperature.

The process and the construction according to the invention enable to solve said problem while providing a suitable positioning for the lining elements with respect to the self-supporting outer wall so that the inside faces of said lining elements be tied to a reference plane as defined hereinabove.

In the present specification the adjective "outer" will be applied to that of any surfaces or faces of any structural element other than the outer wall which is facing towards the inner face of said outer wall whereas the adjective "inner" would apply to an opposite surface or face of said structural element.

The method according to the invention is characterized in that said lining elements are previously provided on that of their faces adapted to be directed towards said outer wall or on raised formations of these faces with a deformable and non resilient material having the consistency of a thick paste or of a cement compound likely to be hardened or set or made rigid later on this material being regularly distributed in patches, lumps or the like over the full surface area of said faces according to any preferably regular pattern or design whatsoever for instance with square, triangular or hexagonal meshes and then applied against said outer wall so that said material be inserted between this outer wall and said lining elements and afterwards brought through crushing, squashing, squeezing, creeping or flowing of said patches to the final positions predetermined by stopping or locating means so that said material continuously or discontinuously fills out the space extending between said inner wall and said lining elements whereas thereafter said material is allowed or caused to harden or set with a view to securing said lining elements in said predetermined positions, the fastening of said lining elements being possibly completed after the final positioning step by operating auxiliary fastening means after or preferably before said hardening or setting step.

The composite wall structure according to the invention such as it may be obtained through said process will therefore comprise an outer rigid self-supporting wall and at least one layer of lining elements the space left between said outer wall and said lining elements being continuously or discontinuously filled up with a rigid stuffing or packing compound material adhesively bonded to said outer wall and to the faces of said lining elements directed towards said outer wall or to projecting formations of such faces, which compound material constitutes both a final positioning means for said lining elements with respect to said outer wall and a means for fastening them onto this outer wall.

According to a preferred form of embodiment of the composite wall of the present invention the distribution of said material is that of an assembly or arrangement of heaps or lumps regularly distributed over the surface of said outer wall and either separated from each other or more or less connected to each other while then forming an integral lacunary structure, every heap being directly bonded both to said outer wall and to said faces of said lining elements or to the projecting formations of the latter.

According to a characterizing feature of the invention said lining elements essentially comprise each one a body made from expanded or cellular synthetic resin of rigid character and along their faces directed towards said outer wall a force and/or stress distributing plate made in particular from plywood, metal or compact synthetic material.

According to another characterizing feature of the method of the invention the lining elements are progressively brought to their final positions through gradual squashing or flattening out of the patches of said material through pressure applied by means of thrust members such for instance as nuts, plunger-nuts or members displaceable according to a translatory motion together with said nuts, which members are gradually movable at right angles to the outer wall along or with respect to stationary members connecting to the said outer wall such as for instance studs secured at right angles to this outer wall and co-operating with said nuts, said stationary connecting members and said nuts forming said auxiliary fastening means in possible co-operation with said stop means.

Said distribution of the material initially deformable and then hardened or set and thus made rigid after positioning of the lining elements through deformation of said material enables to achieve at the same time a gradual positioning of the lining elements and therefore an accurate final positioning of said elements as well as a suitable strong or accurate and lasting fastening of said elements with respect to the outer wall. Moreover the arrangement of said material in patches provides said lining elements with a better bearing support since the bending moments distributed along any radial directions of each patch are better balanced than in any other arrangement of said deformable material. On the other hand the tolerances for the spacing between the inner face of the outer wall and the faces of the lining elements opposite to said outer wall are greater thereby allowing greater tolerances for the surface irregularities of the inner face of said outer wall. These greater tolerances are accounted for by the fact that said material moves more easily and in larger amounts towards the cavities to be filled up than it would do if its arrangement were different for instance done along a line or in a continuous layer; moreover the squeezing or squashing forces to be used for gradually adjusting the final positions of the lining elements are smaller owing to the possibility of displacement, creeping or flowing of said material in any radial directions of the original patches, lumps or heaps.

The method and the composite wall according to the present invention are in particular usable in the wall constructions disclosed in the following patent applications filed by the present applicant:

U.S.—Ser. No. 542,509 filed on Jan. 20, 1975 under the title : "Heat insulating wall structure for fluid-tight tank and the method of making same";

FRANCE—Ser. No. 74. 13, 060 filed on Apr. 12, 1974 under the title : "Dihedral angle construction of heat insulated tank";

FRANCE—Ser. No. 74.16,297 filed on May 10, 1974 under the title : "Heat insulating composite wall construction and tanks for liquefied gases or liquids forming an application thereof".

The present invention will be better understood and further objects, characterizing features, details and advantages thereof will appear more clearly as the following explanatory description proceeds with reference to the accompanying diagrammatic drawings given by way of non limiting examples only illustrating several specific presently preferred forms of embodiment of the invention and wherein.

Figure 4:
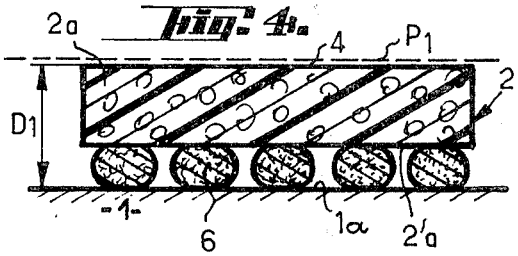
Figure 3:
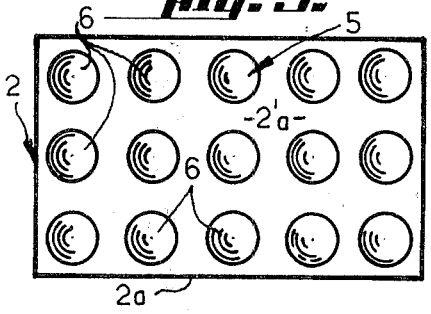
FIG. 3 is a bottom view of this lining element seen from that side thereof which exhibits a deformable compound material arranged in discrete patches, lumps or heaps.
Figure 5:
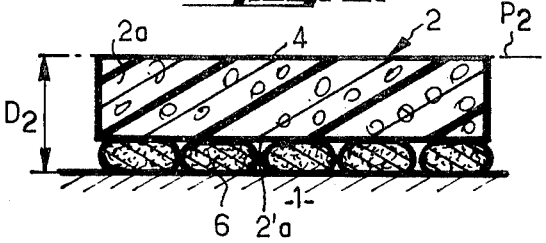
Figure 6:
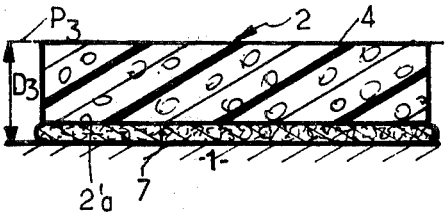
Figure 7:
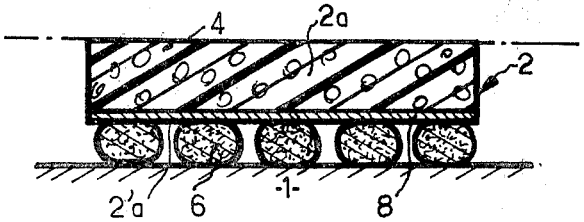
Figure 8:
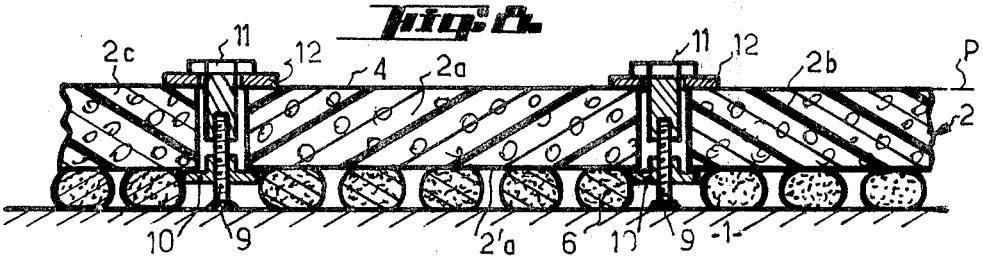
Figure 9:
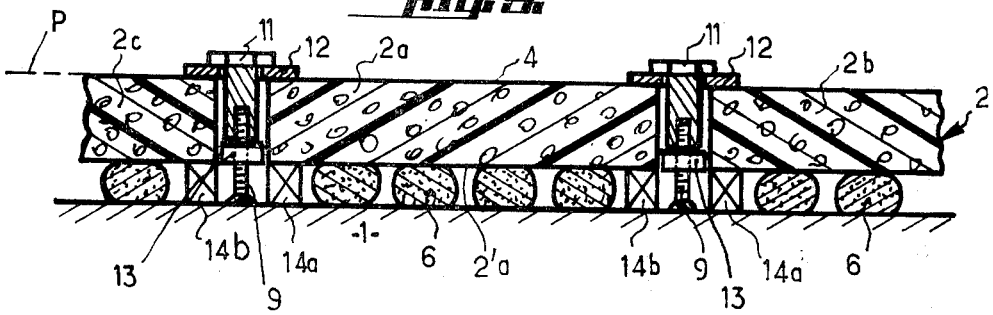
Figure 10:
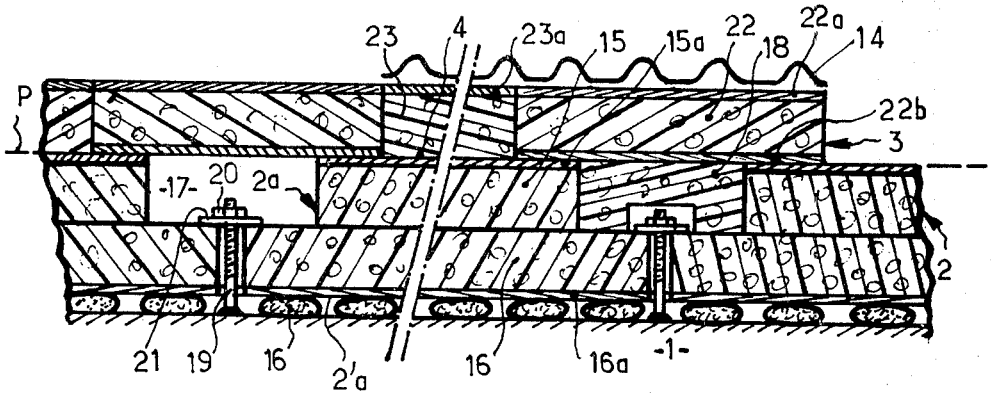
Figure 11:
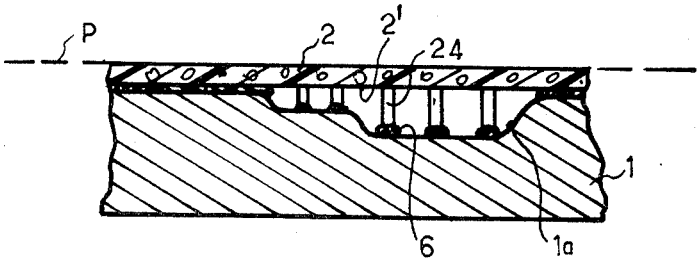
Figure 12:
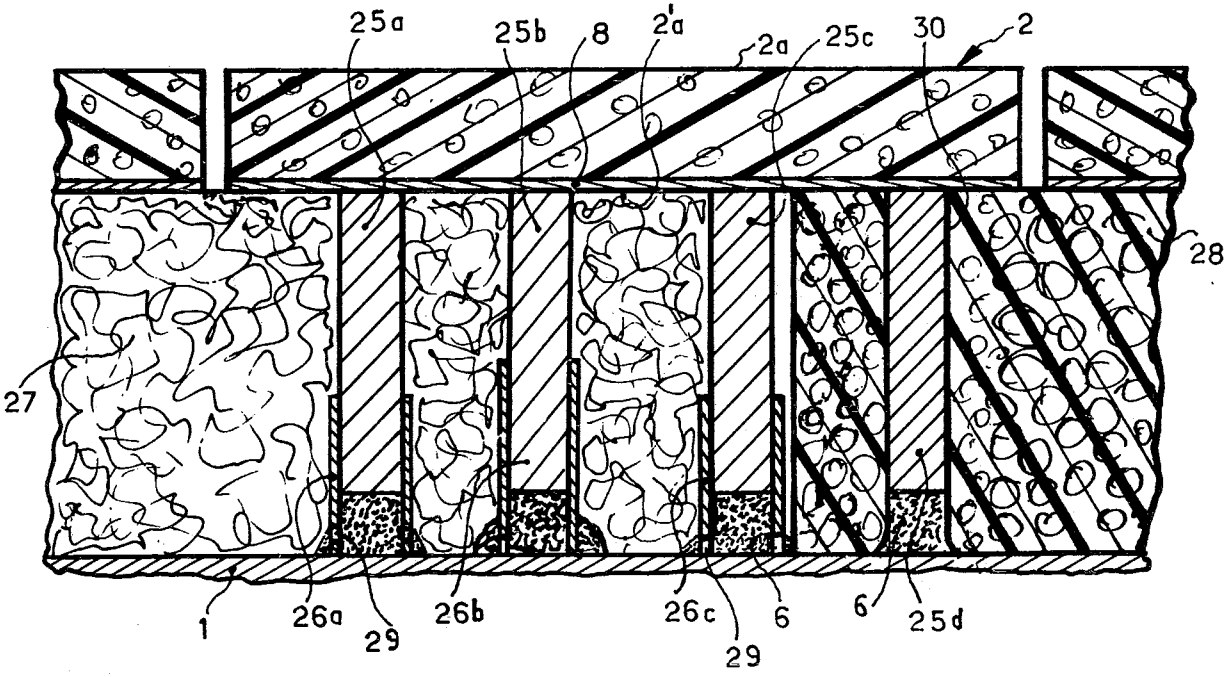

FIGS. 4 to 6 show in cross-section said portion of outer wall onto which the lining element of FIGS. 3 and 4 has been secured or bonded through setting or hardening of said material the latter having been squashed or spread out to a larger extent from the condition of FIG. 3 to that of FIG. 4 according to the respective distances $D_1$, $D_2$ and $D_3$ from the reference plane to the inner face of said outer wall;

FIG. 7 is a view similar to that of FIG. 4, corresponding to another form of embodiment of the composite wall according to the invention and wherein the lining element comprises a distributing plate;

FIGS. 8 and 9 are views similar to that of FIG. 4 showing various means for positioning successive lining elements of a composite wall structure according to the invention;

FIG. 10 is a cross-sectional view of a composite wall according to the invention which comprises a sealing barrier or primary barrier, several layers of lining elements forming a secondary sealing barrier as a heat insulating packing and an outer wall with the interposition of a rigid padding or filling material arranged in heaps separated from each other between said lining elements and said outer wall;

FIG. 11 shows a cross-sectional view of a portion of an outer wall of a tank forming for instance a hold of a ship adapted to the conveyance of liquefied hydrocarbons, the inner surface of which exhibits raised pattern irregularities and to which portion has been adapted a composite wall structure according to another form of embodiment of the invention; and FIG. 12 is a cross-sectional view on an enlarged scale with respect to FIG. 11 showing the composite wall structure according to this other form of embodiment.

Figure 1:
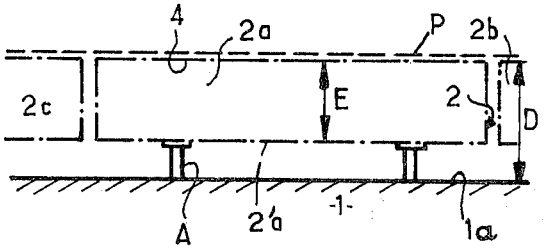
FIG. 1 shows a view in cross-section of a portion of outer wall of the composite wall according to the invention and the reference plane defining the final design positions of the lining elements to be secured to this outer wall.

In the various figures the outer wall of the composite wall according to the invention is denoted by the reference numeral 1 whereas the reference numeral 2 designates a layer of lining elements juxtaposed at the surface and the reference numeral 3 denotes a possible second layer of lining elements (as this is the case in the form of embodiment shown in FIG. 10). Referring to FIG. 1 it is apparent that the final positions of the various lining elements such as 2*a*, 2*b* and 2*c* of the layer 2 shown in dash-dotted lines correspond to the aligned or registering overlying relationship of the inner faces such as 4 of the lining elements with a reference plane shown by the line P and having a stationary predetermined position with respect to the inner face 1*a* of the outer wall 1, the reference character D showing the distance in a portion involved of the composite wall from that reference plane to the face 1*a;* in FIG. 1 have been diagrammatically shown stop or abutment means A enabling to fix or set the position of the reference plane P while taking into account the thickness E of the layer 2 of lining elements; such stop or abutment means may however be dispensed with within the scope of the present invention as the reference plane P may be materialized or made visible for instance by means of laser beams, the fastening of the panels in their final positions being in any case provided by the means to be described hereinafter with reference to FIGS. 2 to 6.

Figure 2:
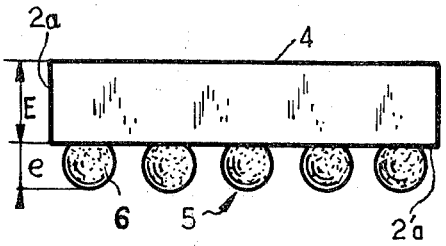
FIG. 2 is an elevational side view of a lining element ready to be applied to the inner face of said outer wall according to the process of the present invention.

In FIGS. 2 and 3 it is seen that a lining element such as 2*a* here shown before being assembled to the outer wall 1 to form a composite wall according to the present invention comprises on its outer face 2'*a* a set of patches, lumps, heaps, pellets or or the like, of a deformable and non resilient material 5 having the consistency of a thick or stiff paste or of a cement compound, these patches 6 of said material 5 being here arranged according to a regular pattern of square meshes; these patches could of course be arranged according to a regular pattern the meshes of which are otherwise shaped for example of triangular of hexagonal configuration or according to any irregular pattern, said patches consisting possibly of differing amounts of deformable material 5 from one patch to another. This material is of a kind likely to become hardened or set or to be made rigid later on either spontaneously or by any suitable physico-chemical means in particular through drying and/or polymerization. This material may in particular be selected among organic resin-based adhesive compounds in particular basically containing polyurethane resin or epoxy resin. With the reference character *e* in FIG. 2 has been denoted the thicknesses of the patches 6 of material 5 transversally of the lining elements before their being applied against the outer wall 1.

Referring to FIG. 4 there is shown a composite wall portion according to the present invention with the lining elements such as 2*a* in their final positions; in the case of this figure, it appears that the patches 6 of said material which are now in a hardened or set and indeformable condition had to be squashed, flattened or spread out before hardening or setting in order that the lining elements may assume the positions shown. The dimensions E, *e* and D should of course comply with the following relation so that there may be produced a squashing of the patches 6 which is required for the suitable final positioning and fastening of the panels;

$$E < D < E+e \qquad 1.$$

In the case of FIG. 4 wherein the patches 6 are slightly squashed or crushed only, D had a particular reference or design value $D_1$ only slightly lower than (E+*e*).

In the form of embodiment shown in FIG. 5, D had a theoretical reference value $D_2$ relatively closer to E, the relation (1) being of course still complied with for the same ground as hereinabove; this case corresponds to a more significant squashing of the patches 6 which may then remain in the form of patches or heaps separated from each other or form more or less interconnected heaps thereby constituting a lacunary integral structure, every patch or heap being adhesively bonded both to the outer wall 1 and to the outer face 2′*a* of the lining elements such as 2*a*.

In the case shown in FIG. 6 which corresponds also to the final positions of the lining elements the patches 6 have been fully squashed and form a substantially continuous compact layer which is denoted by the reference numeral 7 owing to the fact that the distance $D_3$ is here only very little greater than the thickness E of the layer of lining elements.

Although it has here been assumed that the values of E and *e* were predetermined and that on the contrary the position of the reference plane denoted by the line P was variable it was also possible to obtain patches 6 eventually squashed to a more or less significant extent for a given value D and for an also given thickness E by increasing the heights *e* of said patches; it is also possible to reach a more or less continuous or compact final state of said material 5 by increasing the density of distributing the patches 6 over the outer face 2′*a* of the lining elements.

In the form of embodiment shown in FIG. 7 where it has been assumed that in the final positions the patches 6 were squashed to substantially the same degree than in the case of FIG. 4 the lining elements such as 2*a* consist of heat insulating panels which comprise each one a body or core made from expanded or cellular synthetic resin of rigid type this body or core being provided along its outer face with a plate 8 for distributing the forces and/or the stresses exerted or likely to be exerted onto said panels; this distributing plate is in particular made from plywood, metal or synthetic material.

In FIG. 8 have been shown stop or abutment means and auxiliary fastening means for the lining elements such as 2*a*, 2 *b* and 2*c* with respect to the outer wall 1, said fastening means constituting at the same time means for pressing said lining elements thereby allowing the gradual squashing of the patches of deformable material before hardening or setting thereof. Said means comprise in the areas forming the borders against the lining elements stud-bolts, such as 9 welded or otherwise secured to the outer wall 1, each stud-bolt 9 co-operating on the one hand with an adjustable stop or abutment means consisting of a cup-like fitting, a small plate or strip or the like 10 formed with a threaded hole enabling it to be screwed onto the stud-bolt 9 with a view to adjusting the position of said cup-like member and retaining same in a fixed predetermined position, and on the other hand with a plunger nut 11 extending through a small plate, washer or like strip 12 bearing upon the inner face such as 4 of the adjacent lining elements such as 2*a* and 2*c*.

Hereinafter will be explained with reference to FIG. 8 the process of mounting the composite wall. The stud-bolts 9 having been welded onto the outer wall 1, the positions of the cups 10 are adjusted so that when the outer faces such as 2′*a* of the lining elements such as 2*a* will engage said cups the inner faces such as 4 of said lining elements will lie in the reference plane P; the lining elements previously provided with patches of deformable material as shown in FIGS. 2 and 3 are then applied against the wall 1 and afterwards the plunger nuts 11 are adapted onto the stud-bolts 9 with small plates 12 being interposed therebetween; the gradual tightening of the plunger nuts 11 enables owing to the small plates 12 performing the function of thrust elements pressing onto the lining elements of the layer 2 to gradually squash the patches 6 of deformable material until the outer faces of the lining elements are contacting the cups 10 forming abutment means; in this final position the material of the patches 6 is allowed to harden or set thereby eventually fixing the positions of the panels in view of the adhesive bonding achieved between said patches 6 and the outer faces of the lining elements on the one hand and between the same patches and the inner face of the outer wall 1 on the other hand and this even though the nuts 11 happened to be removed or untightened for any reason whatsoever.

In the form of embodiment illustrated in FIG. 9 there are again the stud-bolts 9, the plunger nuts 11 and the small plates 12 but the cups 10 have been omitted and replaced by stops or abutment means 13 screwed onto the stud bolts 9, these abutments here co-operating with the plunger nuts 11 and not with the lining elements; the composite wall here comprises resilient pads such as 14*a* and 14*b* consisting for instance of blocks of elastomeric material which are gradually squeezed at the same time as the patches 6 of deformable material are gradually squashed upon the gradual positioning of the lining elements through screwing of the plunger nuts 11 which in the final position will come in engagement with the abutments 13 the positions of which thus define the reference plane P; when the lining elements are in their final positions the patches 6 are then allowed to harden or set or their hardening or setting is caused to take place by any suitable means.

In the form of embodiment shown in FIG. 10 the composite wall according to the present invention comprises an outer wall 1, a first layer 2 of insulating panels and a second layer 3 of insulating panels as well as a primary sealing barrier 14 consisting of a corrugated metal sheet or according to an alternative form of embodiment, not shown, of a smooth or even metal sheet the fastening of the layer of panels 2 onto the outer wall 1 being achieved as in the foregoing forms of embodiment by means of the patches 6 made from initially deformable material which has been squashed upon positioning of the layer of panels 2 and then hardened or set in the final condition shown in the present figure. Each panel such as 2*a* consists of two elementary component panels 15 and 16 made from cellular or expanded plastics material preferably from expanded polyurethane or expanded polyvinyl chloride or possibly from expanded polystyrene; the elementary component panels such as 15 have at least one of their two surface dimensions smaller than the corresponding dimension of the elementary component panels such as 16 thereby defining in the junction areas between the panels of the layer 12 grooves such as 17 in which may be fitted heat insulating elements of elongated shape such as 18; the insulating panels such as 15 and 16 are secured to each other for instance through adhesive bonding, sticking or gluing; the panel 15 comprises on its inner face a plywood plate or board 15*a* and the panel 16 is provided in its inner face with a plate 16*a* made for instance from plywood for distributing the forces and/or stresses.

Auxiliary fastening means for the panels of the layer 2 are provided in the junction areas between said panels these means comprising stud-bolts 19 secured to the outer wall 1, nuts 20 cooperating with said stud-bolts and small plates or the like 21 bearing on the edges of the elementary component panels such as 16; upon positioning said insulating panels of the layer 2 these small plates 21 form thrust elements enabling to squash the patches 6 when screwing the nuts 20; it should be noted in this form of embodiment that there are no stop or abutment means limiting the displacements of the panels of the layer 2 towards the outer wall 1 when positioning same, the final positions of the inner faces of the panels of the layer 2 being defined by the plane P which may be materialized or made visible by laser beams of small power in order to guide the operating staff carrying out the screwing or tightening of the nuts 20.

The layer 3 consists of a series of insulating panels such as 22 and 23, the panels such as 22 comprising plywood plates or boards denoted 22*a* and 22*b*, respectively, on each one of their opposite faces whereas the panels 23 only comprise plywood plates or boards 23*a* on their outer faces. The connection between the layers 2 and 3 is carried out by adhesive bonding, sticking or gluing of the panels such as 22 to the panels such as 15 so that the bonding areas of such layers form a second sealing or secondary barrier. The positioning of the secondary barrier 14 is of course carried out, as known per se, after fastening of the layer 3 to the layer 2.

It is seen in FIG. 11 that the reference plane P in which the inner faces of the panels of the layer 2 have to be brought may lie at a variable distance from the inner face 1*a* comprising large raised surface pattern or contour irregularities of the outer wall consisting for instance of the side of a ship's hull. It is conceivable in such a case that it is impossible to arrange the deformable material in patches directly placed onto the outer faces 2′ of the panel layers 2. Such a difficulty is overcome by positioning said patches 6 at the ends of rigid or relatively stiff protrusions or projections 24 of the layer 2. Referring now to FIG. 12 there is shown the detailed structures of the projections disclosed in the case of FIG. 11. These projections consist of elongated stake-like or post-shaped elements or the like such as 25*a*, 25*b*, 25*c* and 25*d* of for instance regular or irregular, round, square or any other cross-sectional contour these stakes extending substantially at right angles to the insulating panels such as 2*a* and being preferably secured to the latter for instance through adhesive bonding or gluing. The ends of these stakes are partially fitted into sockets or sleeves such as 26*a* to 26*c*, respectively, made for instance from thick paper-board which have been slipped in force-fitting relationship onto said stakes so that they may not spontaneously slide therealong; upon positioning the panels such as 2*a* the patches 6 of deformable and hardenable or settable compound have been placed inside of said sleeves against the end faces of said stakes while possibly projecting beyond the free ends of said sleeves. Upon positioning of panels such as 2*a* the compound of the patches 6 is squashed or squeezed against the outer wall 1, the sleeves coming in bearing engagement with said wall while sliding more or less with respect to the stakes according to the distance of the layer 2 from the outer wall 1; when the amount of said compound is greater than the volume defined between the outer wall 1, the end face of the stake in its final position and the sleeve contacting said outer wall the compression of said compound results in its flowing through openings, notches or like cut-outs 29 of the sleeves the final condition being then that shown in FIG. 11 for the stakes 25*a*, 25*b* and 25*c*, the case of the stake 25*b* corresponding to a large flow of said compound out of the sleeve. The panel thrusting or pressing means as well as the abutment means thereof and the auxiliary fastening means have not been shown; they may in particular be like those shown in the forms of embodiment of the previous figures. It should be noted that the space left between the stakes may be filled with an insulating packing material such as for instance glass wool, rock wool or any other mineral wool designated by the reference numeral 27 or with yielding panels made from expanded or cellular synthetic resin of the flexible kind, these panels forming for instance thin small plates extending in given parallel rows between the stakes or blocks 28 having ducts or shafts such as 30 through which are extending in tightly fitted relationship stakes such as 25*d* which do not comprise any sleeves, the end of each duct or shaft also comprising a patch 6 of said compound; in the latter case upon positioning of the layer 2 this compound is compressed between the wall of the duct 30, the end of the stake 25*d* and the outer wall 1 and it slightly deforms or strains this wall which is flexible by flowing in particular more or less sidewise in contacting relationship with the outer wall 1 as in the case of stakes provided with sleeves.

The present invention is of course not at all limited to the forms of embodiment disclosed and shown which have been given by way of illustrative examples only. In particular it comprises all the means constituting technical equivalents of the means described as well as their combinations if same are carried out according to its gist and used within the scope of the appended claims.

What is claimed is:

1. A method of making a composite wall structure comprising a rigid self-supporting outer wall, and at least one layer of juxtaposed lining elements substantially parallel to and secured to said outer wall, each one of said lining elements being previously provided on that of its faces which will face towards said outer wall with a deformable and non resilient compound having the consistency of a thick paste and settable in a hardened condition and wherein the improvement consists in the steps of rigidly securing abutment means to said outer wall, that face of said lining elements which faces towards said outer wall abutting on said abutment means, regularly distributing and arranging said compound in patches over the whole surface area of said face according to an at least approximately regular network-like pattern with polygonal meshes, then applying it against said outer wall; causing then said patches to be squashed and flowed by moving each lining element to a predetermined final position defined by said abutment means so that said compound lies in the space left between said outer wall and said lining elements; allowing said compound to set with a view to rigidly securing each lining element into said predetermined final position to said outer wall; and completing the fastening of each lining element in said predetermined final position by the actuation of mechanical fastening means.

2. A method according to claim 1, further comprising the steps of providing each one of said lining elements by making a core-like rigid body portion from cellular synthetic resin and assembling same to a stress-distributing facing plate to which belongs said face which will face towards said outer wall; and applying said patches of compound onto the outside face of said stress-distributing plate.

3. A method according to claim 2, comprising the step of making each stress-distributing facing plate from a material selected from the group comprising: plywood, metal, synthetic material.

4. A method according to claim 1, further comprising the steps of gradually bringing said lining elements to their final positions through gradual squashing and flowing of said compound by exerting a thrust thereon by means of thrust elements gradually movable at right angles to said outer wall along stationary members rigidly secured to said outer wall.

5. A method according to claim 4, comprising the steps of securing stud-bolts forming said stationary members at right angles to said outer wall between said lining elements and using as said thrust elements nuts caused to co-operate with said stud-bolts.

6. A method according to claim 4, comprising the steps of using as said fastening means said stationary members and said thrust elements.

7. A method according to claim 1, comprising the step of adjusting the spacings of said abutment means with respect to said outer wall thereby to controllably adjust said predetermined final positions of said lining elements by securing stud-bolts at right angles to said outer wall between said lining elements and screwing said abutment means onto said stud-bolts.

8. A method according to claim 7, comprising the step of using as said abutment means disc-shaped members having an external part provided with a flat resting surface and a central part provided with a threaded thoroughfare hole co-operating with said stud-bolts.

9. A method of making a composite wall structure comprising a rigid self-supporting outer wall, and at least one layer of juxtaposed lining elements, wherein the improvement consists in the step of providing that face of each of said lining elements which will face towards said outer wall with transverse projections consisting of relatively rigid elongated members extending substantially at right angles to said outer wall and distributed over the whole surface of said face according to an at least approximatively regular network-like pattern, said elongated elements being of various lengths and each of them being of a length corresponding to the distance between that lining element to which it belongs and that area of the outer wall which will face towards said elongated member in a predetermined final position of said lining element; applying a deformable and non resilient compound, having the consistency of a thick paste and settable in a hardened condition, onto the free ends of said elongated elements; fitting a flexible filling material between said layer of lining elements and said outer wall between said elongated elements; causing then the compound applied onto said free ends to be squashed and flowed by moving each lining element to the said predetermined final position; allowing said compound to set with a view to rigidly securing each lining element into said predetermined final position to said outer wall, and completing the fastening of each lining element in said predetermined final position by the actuation of fastening means.

10. A method according to claim 9, further comprising the steps of surrounding the free end of each one of said elongated elements with a sleeve by force-fitting said end into one portion of said sleeve, filling said compound into a projecting portion of said sleeve and causing said sleeve to slide along the end of the elongated element towards said lining element when when moving said lining element to said predetermined final position.

11. In a composite wall structure comprising a rigid self-supporting outer wall and at least one layer of juxtaposed lining elements substantially parallel to said outer wall the improvement consisting in that abutment means are rigidly secured to said outer wall, thoses faces of said lining elements which face towards said outer wall abutting on said abutment means, an indeformable packing compound adhesively bonded to said outer wall and said faces of said lining elements lies in the space left between said outer wall and said lining elements for rigidly securing said lining elements to said outer wall, and mechanical fastening means for completing said rigid securing.

12. A composite wall structure according to claim 11, wherein the distribution of said indeformable packing compound is that of a set of heaps regularly distributed over the surface of said outer wall, each heap being adhesively bonded directly to both said outer wall and said face of the corresponding lining element.

13. A composite wall structure according to claim 11 wherein each one of said lining elements essentially comprises a rigid core-like body portion made from cellular synthetic resin and a stress-distributing facing plate made from a material selected from the group comprising: plywood, metal, synthetic material and assembled to that face of said body portion which is turned towards said outer wall.

14. A composite wall structure according to claim 11, wherein said mechanical fastening means comprise stud-bolts secured at right angles to said outer wall between said lining elements and members bearing against said lining elements, which bearing members comprise nuts co-operating with said stud-bolts.

15. A composite wall structure according to claim 11, wherein said abutment means are screwed onto stud-bolts secured at right angles to said outer wall between said lining elements.

16. A composite wall structure according to claim 11, wherein the distribution of said indeformable packing compound consists of a substantially lacunary arrangement.

17. In a composite wall structure comprising a rigid self-supporting outer wall, and at least one layer of juxtaposed lining elements substantially parallel to said outer wall, the improvement consisting in that each face of said lining elements which face towards said outer wall is provided with transverse projections consisting of relatively rigid elongated members extending substantially at right angles to said outer wall and distributed over the whole/surface of said face according to an at least approximatively regular network like pattern, said elongated members being of various lengths and each of them being of a length corresponding to the distance between that lining element to which it belongs and that area of the outer wall which faces towards said elongated member, an indeformable packing compound adhesively bonded to said outer wall and to the free ends of said elongated elements for rigidly securing said lining elements to said outer wall, the space between said elongated members being filled with a flexible packing material, and mechanical fastening means provided for completing said rigid securement.

18. A composite wall structure according to claim 17, wherein the free ends of said elongated elements are surrounded each one by a portion of a sleeve into which said free end is force-fitted while a projecting portion of said sleeve is filled with said indeformable packing compound.

* * * * *